United States Patent [19]

Ohmori et al.

[11] 4,432,535

[45] Feb. 21, 1984

[54] PRESSURE POURING FURNACE

[75] Inventors: Tsuguharu Ohmori; Sadaumi Ueno, both of Suzuka, Japan

[73] Assignee: Fuji Electric Company, Ltd., Kawasaki, Japan

[21] Appl. No.: 405,737

[22] Filed: Aug. 6, 1982

[30] Foreign Application Priority Data

Aug. 8, 1981 [JP] Japan ..... 56-124570

[51] Int. Cl.[3] ..... B22D 39/00

[52] U.S. Cl. ..... 266/239; 266/236

[58] Field of Search ..... 266/239, 236, 166, 238, 266/237, 240; 222/595, 594

[56] References Cited

U.S. PATENT DOCUMENTS

| | | | |
|---|---|---|---|
| 1,092,938 | 4/1914 | Mellen | 266/166 |
| 3,052,936 | 9/1962 | Hamilton | 222/594 |
| 3,504,825 | 4/1970 | Diamond et al. | 266/239 |
| 3,810,564 | 5/1974 | Allyn et al. | 222/595 |
| 3,998,365 | 12/1976 | Lethen et al. | 222/595 |

OTHER PUBLICATIONS

"Zur Giessgenauigkeit von pneumatisch betätigten Giessöfen" by Horst Hellerling, Düsseldorf, und Kjell Bergmann, Västerås, Schweden, *Giesserei* 65 (1978) No. 25–Dec. 7, pp. 706–709.

"Stand der Mechanisierung und Automatisierung beim Vergiessen von Eisen-Kohlenstoff-Legierungen" by Heinz Wübbenhorst, Essen, *Giesserei* 60 (1973) No. 13, pp. 384–388.

*Primary Examiner*—L. Dewayne Rutledge
*Assistant Examiner*—S. Kastler
*Attorney, Agent, or Firm*—Brumbaugh, Graves, Donohue & Raymond

[57] ABSTRACT

In accordance with this invention, a weir having a given height is provided on the bottom of a molten metal pouring chamber in a pressure pouring furnace so as to surround the periphery of a pouring nozzle port provided on the bottom of the pouring chamber. The molten metal level in the pouring chamber is set to a prelevel corresponding almost to the height of the weir before pouring. The necessary shot pressure to yield a given pouring rate at the time of pouring is thereby adjusted to a smaller pressure than necessary in conventional furnaces, which reduces the lag time between the issuance of a pouring command and the commencement of the pouring operation, thus improving the pouring work efficiency and precision of the furnace.

5 Claims, 7 Drawing Figures

PRESSURE POURING FURNACE

BACKGROUND OF THE INVENTION

The present invention relates to a pressure pouring furnace, and more particularly to a pouring furnace having a shortened lag time between the issuance of a pouring command and the commencing of pouring, whereby the precision and efficiency of the pouring operation is improved.

Known pressure pouring furnaces comprise a closed molten metal storing chamber having a sprue through to the bottom of the molten metal storing chamber. A pouring chamber connects with the storing chamber via a passage rising upwardly from the bottom of the storing chamber. The pouring chamber has an opening at the top, and a pouring nozzle port in the bottom thereof.

Molten metal stored in the storing chamber is fed to the pouring chamber through the upwardly directed passage by directing air pressure onto the surface of the molten metal through an air pipe provided on the top of the storing chamber.

In these known furnaces the molten metal in the pouring chamber is maintained at a "prelevel", i.e., a level somewhat lower than a height of the bottom of the pouring chamber, corresponding almost to the upper end of the passage connecting the pouring chamber and the storing chamber. To initiate pouring an air pressure, or "shot pressure," is applied to the surface of the molten metal for the period of time corresponding to the quantity of the pour desired, to raise the molten metal level in the pouring chamber to a height over the pouring nozzle port in the bottom of the pouring chamber, thereby pouring the desired quantity through the port into a mold at a given rate.

The disadvantage of these known furnaces is that a lag time of several seconds results after the pouring command is issued in order for the molten metal to rise from the prelevel to the desired level for pouring. Similarly, once the pouring commands terminate, there is still another lag time before the level of molten metal in the pouring chamber recedes and pouring actually ceases. Obviously, these lag times reduce the precision with which the pouring operation is accomplished, and reduce the overall efficiency of the operation. This loss of precision and efficiency is particularly exacerbated in an automated pour work in which these lag times accumulate over repeated pouring operations.

SUMMARY OF THE INVENTION

In contrast to the above deficiencies, this invention provides a pressure pouring furnace having an increased pouring precision and efficiency.

More particularly, the invention has a furnace pouring chamber with a weir, having a given height, on the bottom of the molten metal pouring chamber so as to surround the periphery of the pouring nozzle port. The level of the molten metal surface in the pouring room, i.e., the prelevel, is set at a position somewhat lower than the height of the weir before pouring. The shot pressure P to be impressed onto the surface of the molten metal in the molten metal storing chamber at the time of pouring is thereby adjusted by the degree whereat a prelevel value of the molten metal surface in the pouring room is raised according to the height of the weir. The lag time between the issuance of the pouring command and the commencement of pouring is thereby effectively shortened.

BRIEF DESCRIPTION OF THE DRAWINGS

For a better understanding of the present invention, the scope of which will be pointed out in the appended claims, reference is made to the accompanying drawings, in which

DESCRIPTION OF EXEMPLARY EMBODIMENTS

Figure 1:
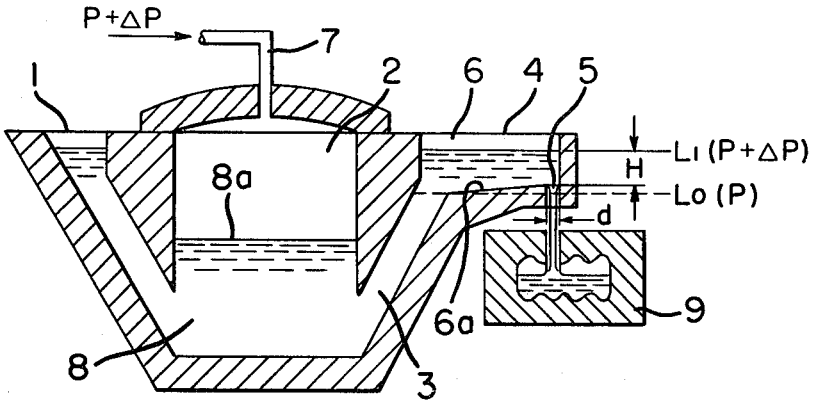
FIG. 1 PRIOR ART
FIG. 1 is a schematic sectional view of a known type of pressure pouring furnace.

FIG. 1 is an illustration of a known pressure pouring furnace comprising a closed molten metal storing chamber 2 having a sprue 1 through to a bottom of the chamber. A molten metal pouring chamber 6, connected through to said storing chamber 2 by way of a passage 3 rising upwardly from the bottom of the storing chamber 2, has an open top 4 and a molten metal pouring nozzle port 5 in its bottom 6*a*. Molten metal 8 is fed to the pouring chamber 6 through the passage 3 by impressing air pressure onto the surface 8*a* of the molten metal 8 stored in the storing chamber 2, by way of an air pipe 7 provided on the top of the storing chamber 2, from a compressed air feeder (not illustrated). The molten metal is poured into a mold 9 through the pouring nozzle port 5 of the pouring chamber 6.

In this known pouring furnace, the molten metal level in the pouring chamber 6 is set at a level somewhat lower than the height of the bottom 6*a* of the pouring chamber 6, i.e., at a level $L_0$ (indicated by the dotted line in FIG. 1, and hereinafter called the "prelevel"). The prelevel corresponds nearly to the upper end of the passage 3, and is maintained by applying a given air pressure P onto the surface 8*a* in the storing chamber 2 through the air pipe 7 from the compressed air feeder prior to pouring a given quantity of the molten metal.

At the time of pouring, an additional air pressure $\Delta P$ (hereinafter called the "shot pressure") is applied onto the surface 8*a* of the molten metal 8 in the storing chamber 2 for the period of time corresponding to the desired pour quantity, thereby raising the level of the molten metal in the pouring chamber 6 up to a height H over the pouring nozzle port 5, as indicated by the line $L_1$ in FIG. 1. Thus, a given quantity of the molten metal 8 is poured into the mold 9 through the pouring nozzle port 5 at a given rate $W_{v1}$ (kg/sec).

However an elapsed time of several seconds is required for the surface in the pouring chamber 6 to rise to the given level $L_1$ from the prelevel $L_0$, or for the pouring rate (kg/sec) through the pouring port 5 to reach the desired value, after the short pressure $\Delta P$ is applied to the molten metal surface 8*a* in the storing chamber 2. A considerably long lag time also is unavoidable for the pouring to come to stop after the shot pressure $\Delta P$ is terminated. Thus, a response lag of several seconds between the issuance of the pouring command and pouring, and also between a pouring stop command and the cessation of pouring, results. This has a deleterious effect on the overall pouring precision in the pouring work. Similarly, and in particular in an automated pouring work through which the above pouring operation is repeated successively, the lag times of the pouring cycles accumulate, thus reducing the efficiency of the pouring work.

Figure 2:
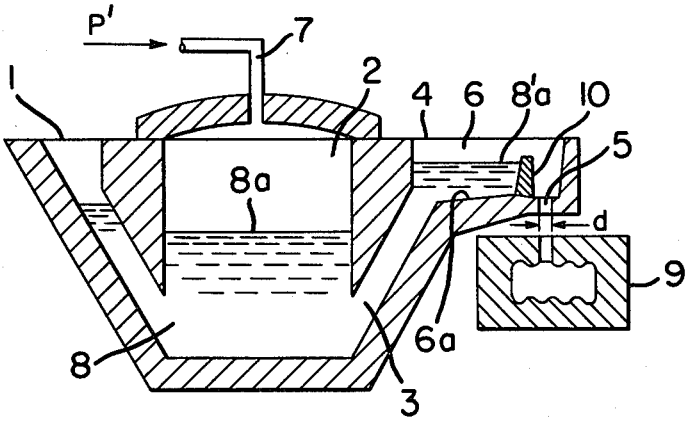
FIG. 2 is a schematic sectional view of a pressure pouring furnace in accordance with the present invention.
Figure 3:
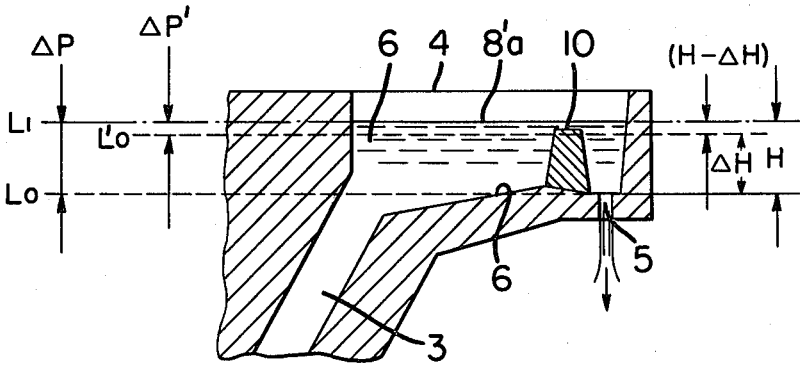
FIG. 3 is a diagrammatic representation of the operation of the pressure pouring furnace of FIG. 2.

A preferred embodiment of the present invention, illustrated in FIGS. 2 and 3, differs from the known furnace of FIG. 1 in that it includes a weir 10 provided in the pouring chamber 6. (Accordingly, like symbols referring to like components are used, for which a further description will be omitted.)

The weir 10 comprises a refractory material on the bottom 6*a* of the pouring chamber 6 which surrounds the pouring nozzle port 5, and which is of a suitable height as will be described below.

The weir 10 is used to set the level of the molten metal surface in the pouring chamber 6, i.e., the prelevel, at a prelevel $L_0'$, which is $\Delta H$ higher than the level $L_0$, corresponding almost to the position in height of the bottom 6*a* of the pouring chamber 6 in the conventional pouring furnace of FIG. 1.

A pouring rate $W_v$ (kg/sec) through the pouring nozzle port 5 of the pouring chamber 6 in the pouring furnace is expressed, from Bernoulli's theorem, as:

$$W_v = k \times P\sqrt{2g \cdot H} \times \frac{\pi}{4} d^2 \quad (1)$$

Here, d denotes an aperture diameter of the pouring nozzle port 5, P a specific gravity of the molten metal 8, H a height of the molten metal 8 from the pouring nozzle port 5, g a gravity constant, and K a flow coefficient.

As will be apparent from Eq. (1), to obtain a given pouring rate $W_{v1}$ in a pouring furnace with d, P and k constant, the molten metal surface 8*a*' in the pouring chamber 6 must be adjusted to a height H over the pouring nozzle port 5.

In the pouring furnace of the invention described above, the prelevel can be set to the level $L_0'$, almost $\Delta H$ higher than the prelevel $L_0$ in that of conventional type illustrated in FIG. 1, due to the weir 10. Therefore, to obtain the same pouring rate $W_{v1}$ (kg/sec) as that of the conventional furnace, it is understood that a smaller shot pressure $\Delta P'$, lower than $\Delta P$ and corresponding to $(H-\Delta H)$ necessary for the surface 8'*a* slightly to exceed the weir 10, can be impressed to the storing chamber 2.

Therefore, in accordance with the invention, the shot pressure $\Delta P'$ to be impressed to the storing chamber 2 to obtain the pouring rate $W_{v1}$ at the time of pouring can be decreased by the degree corresponding to $\Delta H$ from the shot pressure $\Delta P$ in the conventional type of pouring furnace due to the provision of the weir 10. Therefore, the time which is necessary for the surface 8*a*' in the pouring room to rise to the level $L_1$, H higher than the pouring nozzle port 5, can be shortened. I.e., the time necessary for the pouring rate to attain $W_{v1}$ after the shot pressure $\Delta P'$ is impressed to the storing chamber 2 is thereby shortened. Correspondingly, the time which is required until the pouring of the molten metal through the pouring nozzle port 5 comes to a stop after the shot pressure $\Delta P'$ ceases to be applied onto the molten metal surface 8*a* also can be shortened.

Thus, when the pouring command is issued by impressing the relatively small shot pressure $\Delta P'$ necessary for the molten metal surface 8*a*' to exceed the weir 10 in the pouring chamber 6, or the pouring stop command is issued by stopping the shot pressure $\Delta P'$, the lag of the response time to those commands can be shorted by the degree whereat the necessary shot pressure $\Delta P$ in the conventional type of pouring furnace is decreased to $\Delta P'$, i.e., by the degree corresponding to $\Delta H$. Consequently, the molten metal can be poured effectively for the period of time corresponding to a desired pouring quantity at a given pouring rate, thus improving the pouring precision and improving the pouring work efficiency.

A further advantage of the present invention is that a wave motion of the molten metal surface, which is caused in the pouring chamber 6 when the shot pressure is impressed to the storing chamber 2, can be suppressed and maintained at a smaller amplitude, owing to the decrease in the shot pressure as described. This also contributes to improving the pouring precision.

Because the arrangement is such that the molten metal level in the pouring chamber 6 is set at a relatively high prelevel due to the weir 10 before pouring, a temperature change of the refractory body forming the pouring chamber 6 is suppressed, and the occurrence of sporing, or cracking, on the refractory body can thus be prevented. Further, the refractory body of the pouring chamber 6 can be maintained at high temperatures because the quantity of the molten metal stored in the pouring chamber 6 is increased. Thus, the maintenance work required to remove the slag sticking on the wall of the pouring chamber 6 can be performed more efficiently.

Figure 4:
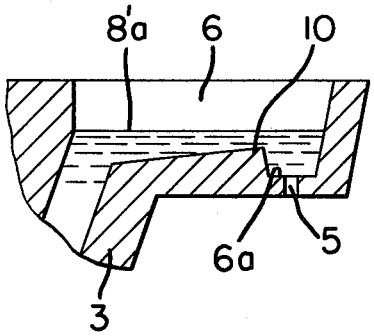
FIGS. 4–7 are partial schematic sectional views of alternative embodiments of the present invention.
Figure 5:
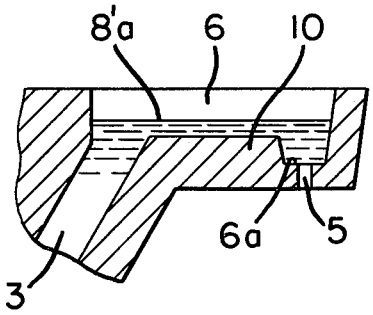
Figure 6:
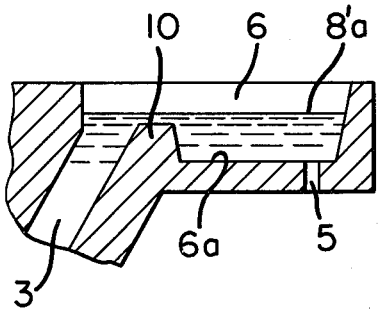
Figure 7:
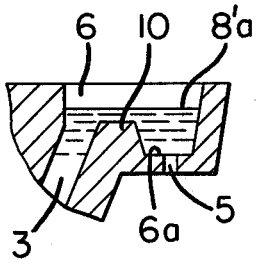

The invention is not limited to the specific embodiment disclosed in FIGS. 2 and 3. For example, the shape and size of the weir 10 surrounding the pouring nozzle port 5, as well as the pouring chamber 6, may be modified as in the embodiments of FIGS. 4–7. In each of these alternative embodiments, unlike the weir disclosed in the embodiment of FIG. 2, the well above the pouring nozzle port 5 is defined by a weir 10 formed integrally with the bottom surface of the pouring chamber 6. In FIGS. 4, 5 and 7 the weir 10 extends from the opening of the passageway 3 leading from the storing chamber almost to the periphery of the pouring nozzle port 5. The top surface of the weir 10 in FIG. 4 inclines upwardly from the opening of the passageway 3 toward the edge of the weir adjacent the pouring nozzle port 5. In FIG. 6 the weir 10 is located in the area immediately adjacent the opening of the passageway 3 into the pouring chamber 6. In each of these alternative embodiments, therefore, the opening of the passageway 3 into the pouring chamber is at a height above the bottom surface 6*a* of the pouring chamber (unlike the FIG. 2 embodiment).

Further, the invention may be utilized, for example, in an electromagnetic pump-type pouring furnace, and is not limited to a pressure pouring furnace. All such variations and modifications within the spirit of the inventive concepts disclosed herein are intended to fall within the scope of the appended claims.

We claim:

1. A molten metal pressure-type pouring furnace comprising a molten metal storing chamber, means for selectively impressing an air pressure onto the surface of molten metal stored in said storing chamber, a pouring chamber having a bottom surface with a pouring nozzle port therein, the area of the bottom surface of the pouring chamber being larger than the cross-sectional area of the pouring nozzle port, a passageway communicating with said storing chamber and having an outlet in said pouring chamber, and a weir having a predetermined height extending above the bottom surface of said pouring chamber to separate the passageway outlet from said pouring nozzle port, wherein said weir is arranged between said outlet and said pouring nozzle port to define a well having a larger cross-sectional area than the cross-sectional area of the pouring nozzle port for receiving a quantity of molten metal desired to be poured so that the level of molten metal is set at a predetermined height above the bottom surface of said pouring chamber and is thereby poured through said pouring nozzle port at a predetermined rate, thereby enabling a prelevel of molten metal in said pouring chamber to be set, at a first air pressure, at a level corresponding almost to the height of said weir, whereby a second air pressure for effecting the pouring of said metal from said well through said pouring nozzle port is reduced.

2. A pouring furnace in accordance with claim 1, wherein said weir is formed integrally with the bottom surface of the pouring chamber.

3. A pouring furnace in accordance with either of claims 1 or 2, wherein said weir is spaced from the periphery of said pouring nozzle port.

4. A pouring furnace in accordance with claim 3, wherein said weir has an upper surface which inclines at a predetermined angle upwardly from said outlet toward an edge spaced from said pouring nozzle port.

5. A pouring furnace in accordance with claim 2, wherein said weir is provided where said outlet of said passageway connects with said pouring chamber.

* * * * *